United States Patent [19]

Kim et al.

[11] 4,374,114

[45] Feb. 15, 1983

[54] PROCESS FOR THE SURFACE MODIFICATION OF CARBON FIBERS

[75] Inventors: Sang N. Kim, Randolph Township, Morris County; Paul E. McMahon, North Plainfield; John P. Riggs, New Providence; John M. Rhodes, Summit, all of N.J.

[73] Assignee: Celanese Corporation, New York, N.Y.

[21] Appl. No.: 222,790

[22] Filed: Jan. 5, 1981

[51] Int. Cl.[3] ..... D01F 9/12

[52] U.S. Cl. ..... 423/447.1; 106/307; 423/447.2

[58] Field of Search ..... 423/447.1, 447.2, 447.4, 423/447.6; 106/307

[56] References Cited

U.S. PATENT DOCUMENTS

| | | | |
|---|---|---|---|
| 3,476,703 | 11/1969 | Wadsworth et al. | 106/307 |
| 3,723,150 | 3/1973 | Druin et al. | 106/307 |
| 3,723,607 | 3/1973 | Kalnin | 106/307 X |
| 3,754,957 | 8/1973 | Druin et al. | 106/307 |
| 3,816,598 | 6/1974 | Cunningham | 106/307 X |
| 3,853,610 | 12/1974 | Byrne et al. | 423/447.2 |

FOREIGN PATENT DOCUMENTS

| | | | |
|---|---|---|---|
| 895990 | 5/1962 | United Kingdom | 106/307 |

*Primary Examiner*—Edward J. Meros

*Attorney, Agent, or Firm*—Burns, Doane, Swecker & Mathis

[57] ABSTRACT

An improved continuous hot gas surface modification process for carbon fibers is provided. The carbon fibers undergoing such processing are passed for a relatively brief residence time through a surface treatment zone to which continuously is fed nitrogen dioxide and air under conditions which have been found to produce a surprisingly effective surface modification. The resulting carbon fibers exhibit a significantly enhanced surface area and an improved ability to bond to a resinous matrix material while retaining a substantial portion of the tensile strength originally exhibited. When incorporated in a resinous matrix material, a fiber reinforced composite article of enhanced interlaminar shear strength is formed.

27 Claims, 2 Drawing Figures

PROCESS FOR THE SURFACE MODIFICATION OF CARBON FIBERS

BACKGROUND OF THE INVENTION

In the search for high performance materials, considerable interest has been focused upon carbon fibers. Graphite fibers or graphitic carbonaceous fibers are defined herein as fibers which consist essentially of carbon and have a predominant x-ray diffraction pattern characteristic of graphite. Amorphous carbon fibers, on the other hand, are defined as fibers in which the bulk of the fiber weight can be attributed to carbon and which exhibit an essentially amorphous x-ray diffraction pattern. Graphitic carbonaceous fibers generally have a higher Young's modulus than do amorphous carbon fibers and in addition are more highly electrically and thermally conductive.

Industrial high performance materials of the future are projected to make substantial utilization of fiber reinforced composites, and graphitic carbonaceous fibers theoretically have among the best properties of any fiber for use as high strength reinforcement. Among these desirable properties are corrosion and high temperature resistance, low density, high tensile strength, and high modulus. Graphite is one of the very few known materials whose tensile strength increases with temperature. Uses for graphitic carbonaceous fiber reinforced composites include recreational equipment such as golf club shafts, aerospace structural components, rocket motor casing, deep submergence vessels, ablative materials for heat shields on re-entry vehicles, etc.

In the prior art numerous materials have been proposed for use as possible matrices in which graphitic carbonaceous fibers may be incorporated to provide reinforcement and produce a composite article. The matrix material which is selected is commonly resinous in nature (e.g. a thermosetting resinous material) and is commonly selected because of its ability to also withstand highly elevated temperatures.

While it has been possible in the past to provide graphitic carbonaceous fibers of highly desirable strength and modulus characteristics, difficulties have arisen when one attempts to gain the full advantage of such properties in the resulting fiber reinforced composite articles. Such inability to capitalize upon the superior single filament properties of the reinforcing fiber has been traced to inadequate adhesion between the fiber and the matrix in the resulting composite article.

Numerous techniques have been proposed in the past for modifying the fiber properties of a previously formed carbon fiber in order to make possible improved adhesion when present in a composite article. These techniques generally can be classified as either hot gas surface treatments, liquid oxidative surface treatments, or surface coating procedures.

Representative hot gas carbon fiber surface treatments include those disclosed in U.S. Pat. Nos. 3,476,703; 3,723,150; 3,723,607; 3,745,104; and 3,754,957; British Pat. Nos. 1,180,441 and 1,225,005; and Japanese Pat. No. 75-6862. U.S. Pat. No. 3,476,703 and British Pat. No. 1,180,441 disclose heating carbon fibers normally within the range of 350° to 850° C. in a gaseous oxidizing atmosphere such as air for an appreciable period of time. It is there mentioned that an oxygen rich or pure oxygen atmosphere, or an atmosphere containing an oxide of nitrogen may be used. U.S. Pat. No. 3,745,104 discloses a process wherein carbon fibers are subjected to a gaseous mixture of an inert gas and a surface modification gas such as oxygen or nitrogen dioxide in the presence of high frequency electrical power. Japanese Pat. No. 75-6862 discloses treating carbon fibers with a nitrogen monoxide atmosphere.

Representative hot gas plasma treatments are disclosed in U.S. Pat. Nos. 3,767,774; 3,824,398; and 3,872,278.

Representative liquid oxidative surface treatments are disclosed in U.S. Pat. Nos. 3,657,082; 3,671,411; 3,759,805; 3,859,187; and 3,894,884. It generally is essential that the carbon fibers treated in this manner be washed and dried following the liquid oxidative surface treatment.

Representative surface coating procedures are disclosed in U.S. Pat. Nos. 3,762,941 and 3,821,013.

Nevertheless the need has remained for an improved process for the surface modification of carbon fibers which expeditiously can be carried out on an economical basis, while retaining to a substantial degree the tensile strength exhibited prior to the surface treatment.

It is an object of the invention to provide an improved continuous gas phase process for efficiently modifying the surface characteristics of carbon fibers.

It is an object of the invention to provide an improved process for enhancing the ability of carbon fibers to bond to a resinous matrix material.

It is an object of the invention to provide an improved process for modifying the surface characteristics of carbon fibers which may be conducted relatively rapidly and in a controllable manner.

It is an object of the invention to provide an improved process for modifying the surface characteristics of carbon fibers which can be carried out relatively economically without the requirement that a fiber wash step be conducted following the surface modification step.

It is an object of the invention to provide an improved process for modifying the surface characteristics of carbon fibers which has been found to produce a great increase in the surface area of the carbon fibers.

It is an object of the invention to provide an improved process for modifying the surface characteristics of carbon fibers which has been found to be effective with a wide range of carbon fibers of greatly varying Young's moduli levels (e.g. 30 to 80 million psi, or more).

It is an object of the invention to provide an improved process for modifying the surface characteristic of carbon fibers so as to improve their ability to bond to a resinous matrix material while retaining a substantial portion of the tensile strength intact.

It is another object of the invention to provide composite articles exhibiting an improved interlaminar shear strength which are reinforced with the resulting surface modified carbon fibers.

It is a further object of the invention to provide composite articles which are reinforced with the resulting surface modified carbon fibers and exhibit no substantial first failure mode in tensile strength evaluation.

These and other objects, as well as the scope, nature, and utilization of the invention will be apparent from the following detailed description and appended claims.

SUMMARY OF THE INVENTION

It has been found that an improved process for the modification of the surface characteristics of a carbonaceous fibrous material containing at least 90 percent carbon by weight so as to improve its ability to bond to a resinous matrix material while retaining a substantial portion of the tensile strength thereof comprises:

(a) continuously feeding to a substantially enclosed surface treatment zone maintained at a temperature of approximately 300° to 800° C. a gaseous atmosphere comprising approximately 1 to 25 percent by volume nitrogen dioxide and approximately 75 to 99 percent by volume air, (b) continuous passing a continuous length of the carbonaceous fibrous material in the direction of its length through the surface treatment zone for a residence time of approximately 20 to 180 seconds, and (c) continuously withdrawing the resulting continuous length of carbonaceous fibrous material from the surface treatment zone.

DESCRIPTION OF PREFERRED EMBODIMENTS

The Starting Material

Figure 1:
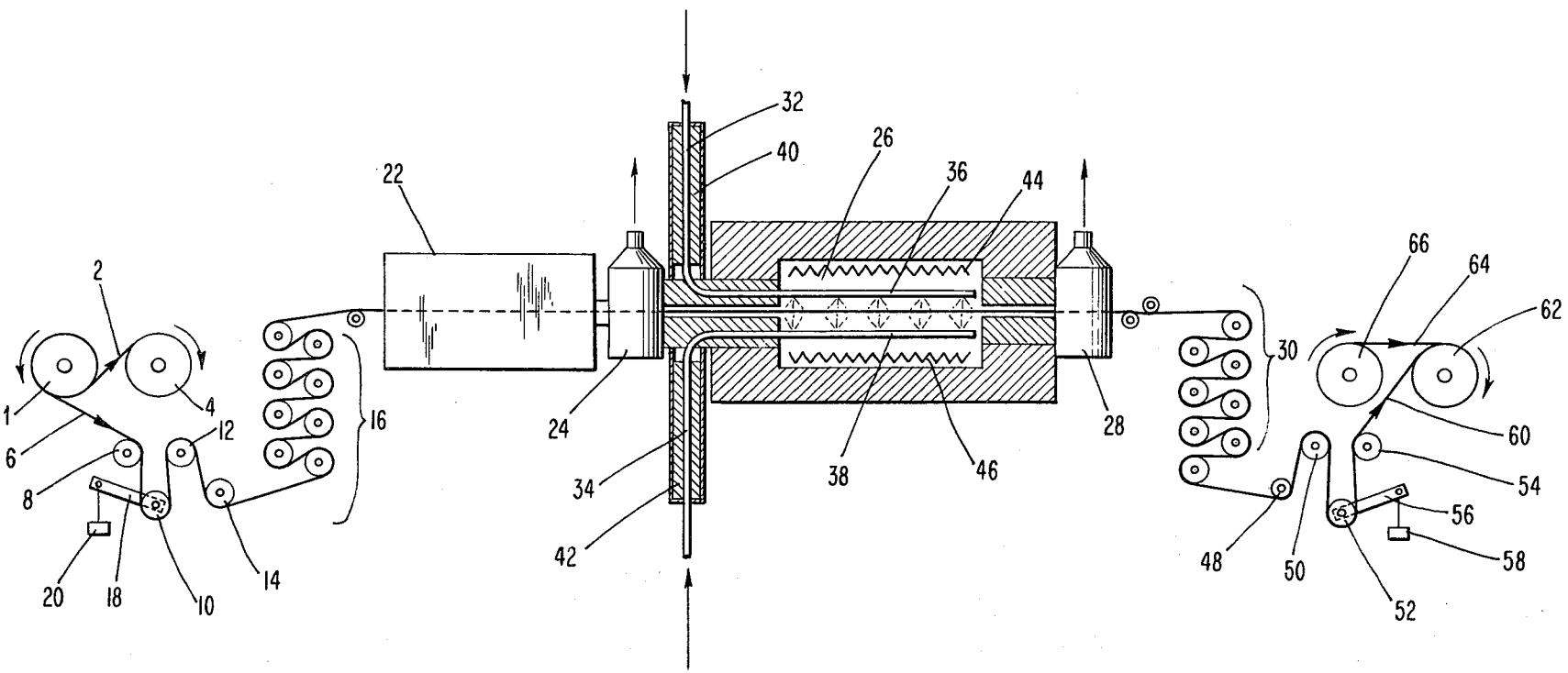
FIG. 1 is a schematic illustration of an apparatus arrangement capable of carrying out the process of the present invention.

The carbonaceous fibers which are modified in accordance with the process of the present invention contain at least about 90 percent carbon by weight and optionally may exhibit a predominantly graphitic x-ray diffraction pattern. In a preferred embodiment of the process the carbonaceous fibers which undergo surface modification contain at least about 93 percent carbon by weight. Graphitized carbonaceous fibrous materials commonly contain at least 95 percent carbon by weight (e.g. at least 99 percent carbon by weight).

The carbonaceous fibers are provided as a continuous length of fibrous material and can be provided in any one of a variety of physical configurations provided substantial access to the fiber surface is possible during the surface modification treatment described hereafter. For instance, the fibrous materials may assume the configuration of a continuous length of a multifilament yarn, tape, tow, strand, cable, or similar fibrous assemblage. In a preferred embodiment of the process the fibrous material is one or more continuous multifilament yarn or a tow. When a plurality of multifilament yarns or tows are surface treated simultaneously, they may be continuously passed through the surface treatment zone while in parallel and in the form of a flat ribbon or tape while being joined by a crossweave.

The carbonaceous fibrous material which is treated in the present process optionally may be provided with a twist which tends to improve the handling characteristics. For instance, a twist of about 0.1 to 5 tpi, and preferably about 0.3 to 1.09 tpi, may be imparted to a multifilament yarn. Also a false twist may be used instead of or in addition to a real twist. Alternatively, one may select continuous bundles of fibrous material which possess essentially no twist.

The carbonaceous fibers which serve as the starting material in the present process may be formed in accordance with a variety of techniques as will be apparent to those skilled in the art. For instance, organic polymeric fibrous materials which are capable of undergoing thermal stabilization may be initially stabilized by treatment in an appropriate atmosphere at a moderate temperature (e.g., 200° to 400° C.), and subsequently heated in a non-oxidizing atmosphere at a more highly elevated temperature, e.g. 900° to 1400° C., or more, until a carbonaceous fibrous material is formed. If the fibrous material following such heating at 900° to 1400° C. is heated to a maximum temperature of 2,000° to 3,100° C. (preferably 2,400° to 3,100° C.) in non-oxidizing atmosphere, substantial amounts of graphitic carbon are commonly detected in the resulting carbon fiber.

The exact temperature and atmosphere utilized during the initial stabilization of an organic polymeric fibrous material commonly vary with the composition of the precursor as will be apparent to those skilled in the art. During the carbonization reaction elements present in the fibrous material other than carbon (e.g. oxygen, nitrogen and hydrogen) are substantially expelled. Suitable organic polymeric fibrous materials from which the fibrous material capable of undergoing carbonization may be derived include an acrylic polymer, a cellulosic polymer, a polyamide, a polybenzimidazole, polyvinyl alcohol, pitch, etc. As discussed hereafter, acrylic polymeric materials are particularly suited for use as precursors in the formation of carbonaceous fibrous materials. Illustrative examples of suitable cellulosic materials include the natural and regenerated forms of cellulose, e.g. rayon. Illustrative examples of suitable polyamide materials include the aromatic polyamides, such as nylon 6T, which is formed by the condensation of hexamethylenediamine and terephthalic acid. An illustrative example of a suitable polybenzimidazole is poly-2,2′-m-phenylene-5,5′-bibenzimidazole. Suitable pitch base fibers may be derived from petroleum or coal tar pitch.

A fibrous acrylic polymeric material prior to stabilization may be formed primarily of recurring acrylonitrile units. For instance, the acrylic polymer should be an acrylonitrile homopolymer or an acrylonitrile copolymer which contains at least 85 mole percent of recurring acrylonitrile units with not more than about 15 mole percent of a monovinyl compound which is copolymerizable with acrylonitrile such as styrene, methyl acrylate, methyl methacrylate, vinyl acetate, vinyl chloride, vinylidene chloride, vinyl pyridine, and the like, or a plurality of such monovinyl compounds. In this context the term "copolymer" includes terepolymers, quadpolymers, etc.

During the formation of a preferred carbonaceous fibrous material for use in the present process multifilament bundles of a acrylic fibrous material may be initially stabilized in an oxygen-containing atmosphere (i.e., preoxidized) on a continuous basis. See, for instance, commonly assigned U.S. Pat. No. 3,539,295. The stabilized acrylic fibrous material which is preoxidized in an oxygen-containing atmosphere is black in appearance, contains a bound oxygen content of at least about 7 percent by weight as determined by the Unterzaucher analysis, retains its original fibrous configuration essentially intact, and is non-burning when subjected to an ordinary match flame.

Suitable techniques for transforming a stabilized acrylic fibrous material into a carbonaceous fibrous material are disclosed in commonly assigned U.S. Pat. Nos. 3,775,520; 3,818,682; 3,900,556; and 3,954,950.

In accordance with a particularly preferred carbonization and graphitization technique a continuous length of stabilized acrylic fibrous material which is non-burning when subjected to an ordinary match flame and derived from an acrylic fibrous material selected from the group consisting of an acrylonitrile homopolymer and acrylonitrile copolymers which contain at least about 85 percent of acrylonitrile units and up to about 15 mole percent of one or more monovinyl units copolymerized therewith is converted to a graphitic fibrous material while preserving the original fibrous configuration essentially intact while passing through a carbonization/graphitization heating zone containing a non-oxidizing gaseous atmosphere and a temperature gradient in which the fibrous material is raised within a period of about 20 to about 300 seconds from about 800° C. to a temperature of about 1,600° C. to form a continuous length of carbonized fibrous material, and in which the carbonized fibrous material is subsequently raised from about 1,600° C. to a maximum temperature of at least about 2,400° C. within a period of about 3 to 300 seconds where it is maintained for about 10 seconds to about 200 seconds to form a continuous length of graphitic fibrous material.

The equipment utilized to produce the heating zone used to produce the carbonaceous starting material may be varied as will be apparent to those skilled in the art. It is essential that the apparatus selected be capable of producing the required temperature while excluding the presence of an oxidizing atmosphere.

In a preferred technique the continuous length of fibrous material undergoing carbonization is heated by use of a tubular resistance heated furnace. In such a procedure the fibrous material may be passed in the direction of its length through the tube of such furnace. For large scale production, it is of course preferred that relatively long tube furnaces be used so that the fibrous material may be passed through the same at a more rapid rate while being carbonized. The fibrous material because of its small mass and relatively large surface area instantaneously assumes substantially the same temperature as that of the zone through which it is continuously passed.

The carbonaceous fibrous material selected commonly possesses an average single filament Young's modulus of about 30 to 80 million psi, or more, depending largely upon the processing temperatures utilized during formation. Additionally, the carbonaceous fibrous material commonly exhibits an average single filament tensile strength of at least 200,000 psi, e.g. about 250,000 to 500,000 psi. The Young's modulus of the fiber may be determined by the procedure of ASTM Designation D-2343. The tensile strength may be determined by the procedure of ASTM Designation D-3379.

The Surface Modification

The zone in which the surface modification is carried out is substantially enclosed and is provided with appropriate openings for the carbonaceous fibrous material to enter and leave. The surface treatment zone conveniently may take the form of a tubular furnace provided with sparge tubes through which the nitrogen dioxide and air gases are introduced. The furnace preferably is constructed of an acid resistant metal such as Inconel metal which is a commercially available alloy of nickel and chromium. Provisions can be made to prevent the loss of gases from the surface treatment zone into the atmosphere by use of secondary chambers at the furnace inlet and outlet connected to an exhaust system equipped with a nitrogen dioxide stripping apparatus.

A flowing gaseous environment is maintained within the surface treatment zone by continuously introducing a gaseous atmosphere comprising approximately 1 to 25 percent by volume (preferably approximately 2 to 10 percent by volume) nitrogen dioxide and approximately 75 to 99 percent by volume (preferably 90 to 98 percent by volume) air. The flow of gas is maintained within the surface treatment zone by continuously withdrawing a substantially identical quantity of exhaust gas as that which is continuously introduced. The nitrogen dioxide and air preferably are introduced into the surface treatment zone immediately above and below the moving continuous length of carbonaceous fibrous material by means of sparge tubes. The air employed preferably is substantially free of moisture.

The exhaust gas may be withdrawn from the surface treatment zone at the inlet and outlet for the moving continuous length of carbonaceous fibrous material by means of the secondary exhaust chambers described above. At the time of introduction into the surface treatment zone the nitrogen dioxide and air conveniently can be preheated to allow an $NO_2$:NO equilibrium to be preliminarily established.

The temperature of the gaseous atmosphere within the surface treatment zone is maintained at a temperature within the range of approximately 300° to 800° C. Such atmosphere preferably is maintained at a substantially uniform temperature within this range. The temperature selected for optimum results is influenced by the modulus of the carbonaceous fibrous material and the concentration of the nitrogen dioxide fed to the surface treatment zone. In a preferred embodiment such processing temperature is achieved by preheating the nitrogen dioxide and air and providing the surface treatment zone with appropriately controlled heating means. Other techniques for achieving the processing temperature will be apparent to those skilled in the art.

The pressure within the surface treatment zone preferably is maintained at substantially atmospheric pressure. In a particularly preferred embodiment the pressure is maintained slightly below atmospheric pressure to minimize the possibility of nitrogen dioxide leakage. However, super-atmospheric pressures as well as more extreme subatmospheric pressures may be employed.

The carbonaceous fibrous material continuously is passed in the direction of its length through the surface treatment zone for a residence time of approximately 20 to 180 seconds. The optimum residence time selected will be dependent upon the processing history of the carbonaceous fibrous material, the relative concentrations of nitrogen dioxide and air fed to the surface treatment zone, and the temperature of the gaseous atmosphere maintained in the surface treatment zone. The carbonaceous fibrous material preferably is suspended in the surface treatment zone so that good contact between the gaseous atmosphere and the surface of the carbon fibers is made possible. For instance, the continuous length of carbonaceous fibrous material can be axially suspended within the center of a tubular surface treatment zone through which the required gases are caused to flow. Rollers optionally may be provided within the surface treatment zone so as to aid in directing the movement of the continuous length of carbonaceous fibrous material undergoing treatment.

In a preferred embodiment wherein the carbonaceous fibrous material prior to surface modification exhibits an average single filament Young's modulus of approximately 30 to 50 million psi, the surface treatment zone is maintained at a temperature of approximately 300° to 800° C. (e.g., 320° to 440° C. in a particularly preferred embodiment), the gaseous atmosphere which is fed to the surface treatment zone comprises approximately 1 to 25 percent by volume nitrogen dioxide (e.g., 2 to 10 percent by volume in a particularly preferred embodiment) and approximately 75 to 99 percent by volume air (e.g., 90 to 98 percent by volume in a particularly preferred embodiment), and the carbonaceous fibrous material is passed through the surface treatment zone for a residence time of approximately 20 to 180 seconds (e.g. approximately 25 to 90 seconds in a particularly preferred embodiment).

In a preferred embodiment wherein the carbonaceous fibrous material prior to surface modification contains at least 95 percent carbon by weight, a substantial quantity of graphitic carbon, and exhibits an average single filament Young's modulus of at least 60 million psi, the surface treatment zone is maintained at a temperature of approximately 300° to 800° C. (e.g., 450° to 800° C. in a particularly preferred embodiment), the gaseous atmosphere which is fed to the surface treatment zone comprises approximately 1 to 25 percent by volume nitrogen dioxide (e.g., 2 to 10 percent by volume in a particularly preferred embodiment) and approximately 75 to 99 percent by volume air (e.g., 90 to 98 percent by volume in a particularly preferred embodiment), and the carbonaceous fibrous material is passed through the surface treatment zone for a residence time of approximately 20 to 180 seconds (e.g., approximately 25 to 90 seconds in a particularly preferred embodiment).

It will be recognized by those skilled in the chemistry of nitrogen dioxide at elevated temperatures that a complex equilibrium reaction will exist between the gases present in the surface treatment zone since a portion of the $NO_2$ will be transformed to NO and such transformation is influenced by the temperature of the surface treatment zone. The critical parameter of the claimed process, however, is defined as heretofore stated and resides in the feeding of the designated relative volumes of nitrogen dioxide and air to the surface treatment zone with the respective volumes being computed prior to the transformation of a portion of the nitrogen dioxide to nitrogen monoxide.

In a preferred embodiment the carbonaceous fibrous material is in a substantially anhydrous form when passed through the surface treatment zone. For instance, the carbonaceous fibrous material may be preliminarily passed through a dryer provided with a heated nitrogen atmosphere (e.g., at approximately 540° C.) prior to reaching the surface treatment zone.

Standard precautions must be taken to insure the safe handling of the nitrogen dioxide so as to insure the well being of those in the area. Nitrogen dioxide and other oxides of nitrogen conveniently can be removed from the exhaust gas by scrubbing.

It surprisingly has been found that the present process in spite of its rapidity and simplicity enables the retention of a substantial portion of the average single filament tensile strength of the carbonaceous fibrous material undergoing treatment or in some instances even an increase in such tensile strength. More specifically, the carbonaceous fibrous material commonly retains at least 70 percent of its average single filament tensile strength following the surface modification, and preferably at least 90 percent of such tensile strength. Accordingly, surface treated carbon fibers can be formed which exhibit a mean single filament tensile strength of at least 180,000 psi (e.g., 200,000 to 500,000 psi, or more). The present process is believed to be capable of smoothing critical flaws which would otherwise initiate failure so that higher forces are required to induce failure thereby making possible relatively high filament tensile strength values.

The process of the present invention is believed to offer significant advantages over various surface modification procedures suggested in the prior art. For instance, the residence time required to carry out the present process tends to be substantially less than if a hot gas surface treatment were carried out in air alone. The explosion hazard posed by the use of pure oxygen in a hot gas surface treatment is avoided. The expense and toxicity hazard posed by a surface modification in pure nitrogen dioxide is greatly minimized. The effectiveness of the surface modification has been found to be substantially improved over that obtained when pure nitrogen monoxide is fed to the surface treatment zone. Any loss of tensile strength greatly is minimized under the conditions employed in the present process. Additionally, extended processing times and equipment requirements posed by a liquid oxidative surface treatment are avoided. For instance, no washing or drying steps are required when carrying out the present process. Also, the physical configuration of the multifilamentary carbonaceous fibrous material (e.g. the width of a tape) may be readily controlled during the surface modification treatment of the present process.

The theory whereby the present process operates to yield a highly desirable surface modification is considered to be complex and incapable of simple explanation. The surface of the carbonaceous fibrous material is believed to be modified both physically and chemically. Such physical modification commonly includes a substantial increase in the fiber surface area which is attributable to tiny pores on the fiber surface.

The surface treatment of the present process makes possible improved adhesive bonding between the carbonaceous fibers, and a resinous matrix material. Accordingly, carbon fiber reinforced composite materials which incorporate fibers treated as heretofore described exhibit enhanced interlaminar shear strength, flexural strength, compressive strength, etc. The resinous matrix material employed in the formation of such composite materials is commonly a polar thermosetting resin such as an epoxy, a polyimide, a polyester, a phenolic, etc. The carbonaceous fibrous material is commonly provided in such resulting composite materials in either an aligned or random fashion in a concentration of about 20 to 70 percent by volume.

The following examples are given as specific illustrations of the invention with reference being made to the apparatus arrangement of FIG. 1. It should be understood, however, that the invention is not limited to the specific details set forth in the examples.

EXAMPLE I

A high strength relatively low modulus yarn of carbonaceous continuous filamentary material derived from an acrylonitrile copolymer consisting of approximately 98 mole percent of acrylonitrile units and 2 mole percent methylacrylate units was selected as the starting material. The carbonaceous filamentary material contained approximately 93 percent carbon by weight and was commercially available from the Celanese Corporation under the designation Celion 6000, Lot 8022 carbon fiber. The starting material had been thermally stabilized in an oxygen-containing atmosphere and subsequently converted to the carbonaceous form by heating at a more highly elevated temperature in a non-oxidizing atmosphere. Representative filament properties for the starting material were an average denier of approximately 0.6, an average tensile strength of approximately 424,000 psi, an average Young's modulus of approximately 35,000,000 psi, and an average elongation of approximately 1.2 percent.

A plurality of substantially untwisted parallel side-by-side ends of the starting material were provided on driven flanged bobbin 1 together with an interlay of Kraft paper 2. As the flanged bobbin 1 was caused to rotate the interlay of Kraft paper 2 was collected on driven flanged bobbin 4 and the flat tape of the carbonaceous fibrous material 6 was passed to idler rollers 8, 10, 12 and 14 and then to a series of driven feed rollers 16. The feed rollers 16 were driven by a variable speed motor (not shown) by means of a chain drive (not shown). The speed of driven flanged bobbin 1 was controlled by the position of dancer arm 18 and weight 20.

The tape of carbonaceous fibrous material was passed at a rate of approximately 72 inches per minute through dryer 22, secondary exhaust chamber 24, surface treatment zone 26, and secondary exhaust chamber 28 prior to being passed over a series of driven take-up rollers 30. The driven take-up rollers 30 maintained the carbonaceous filamentary material at a substantially constant length as it passed through dryer 22, secondary exhaust chamber 24, surface treatment zone 26, and secondary exhaust chamber 28. The take-up rollers 30 were driven by a variable speed motor (not shown) by means of a chain drive (not shown).

Dryer 22 had a length of 36 inches and was provided with nitrogen atmosphere at a temperature of approximately 540° C. The carbonaceous fibrous material was present therein for a residence time of approximately 30 seconds.

A gaseous mixture consisting of 9 percent by volume nitrogen dioxide and 91 percent by volume air was fed to the surface treatment zone 26 via inlet tubes 32 and 34 which inside the surface treatment zone 26 were provided with a plurality of openings directed towards the carbonaceous fibrous material thereby forming gas sparge tubes 36 and 38. Inlet tubes 32 and 34 were surrounded by auxiliary heaters 40 and 42 respectively which preheated the gaseous mixture to a temperature of approximately 350° C. The gaseous nitrogen dioxide was derived from commercially available liquefied nitrogen dioxide which was preheated and volatilized, and passed through an appropriate flow meter (not shown) to inlet tubes 32 and 34. Substantially atmospheric pressure was maintained within the surface treatment zone 26.

The surface treatment 26 possessed a hot zone length of 36 inches and the carbonaceous fibrous material was present therein for approximately 30 seconds. Situated within the walls of surface treatment zone 26 were resistance heaters 44 and 46 which maintained the interior of the surface treatment zone at approximately 380° C.

Exhaust gas was continuously withdrawn from the surface treatment zone 26 via secondary exhaust chambers 24 and 28 which were connected to an appropriate nitrogen dioxide stripping apparatus to avoid discharge of nitrogen dioxide into the atmosphere.

Following contact with the series of driven take-up rollers 30 the tape of surface treated carbonaceous filamentary material is passed around idler rollers 48, 50, 52 and 54. The surface treated product 60 was collected on flanged bobbin 62 and wound between Kraft paper interlay 64 supplied from flanged bobbin 66. The speed of flanged bobbin 62 was controlled by the position of dancer arm 56 and weight 58.

Figure 2:
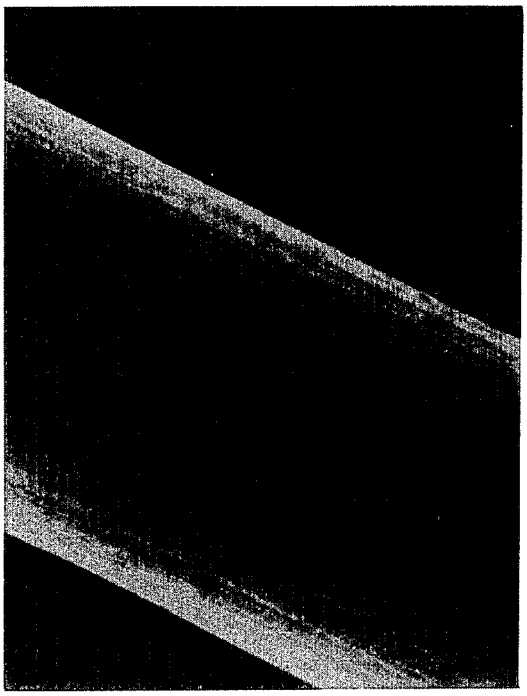
FIG. 2 illustrates the appearance of a typical carbon filament which has been surface treated by the process of the present invention. This photograph was made with the aid of a scanning electron microscope at a magnification of approximately 10,000X.

FIG. 2 illustrates the appearance of a typical surface treated filament of the carbonaceous material with the aid of a scanning electron microscope at a magnification of approximately 10,000X. Such filament exhibits a propensity to better adhere to a matrix material as well as an increased surface area.

Standard opposite test bars were next formed employing the surface treated carbonaceous fibrous material as a reinforcing media in an epoxy matrix material. More specifically, the filaments were placed unidirectionally in X934 epoxy resin available from the Fiberite Corporation, and cured. For control purposes similar test bars were formed from the untwisted Celion 6000, Lot 8022, carbon fibers in absence of the surface treatment of the present invention. The results are summarized below for test bars normalized to a fiber concentration of 62 percent by volume.

| Composite Property | Example I | Untreated Control |
|---|---|---|
| Flexural Strength | 278,000 psi | 259,000 psi |
| Flexural Modulus | 19,000,000 psi | 19,000,000 psi |
| Horizontal Interlaminar Shear Strength | 16,800 psi | 11,300 psi |
| Tensile Strength | 249,000 psi | 239,000 psi |
| Tensile Modulus | 20,100,000 psi | 20,700,000 psi |
| Elongation | 1.24 percent | 1.17 percent |

The horizontal interlaminar shear strength, which is a good measure of the level of bonding between the fibrous reinforcement and the matrix, was determined by short beam testing of the fiber reinforced composite according to the procedure of ASTM D2344-65T as modified for straight bar testing at a 4:1 span to depth ratio.

EXAMPLE II

Example I was substantially repeated with the exception that the surface zone 26 was maintained at a temperature of approximately 320° C. Again Celion 6000 high strength carbon fiber from Lot 8022 was employed. In this instance composite properties were not obtained as in Example I, but rather impregnated strand tensile properties were obtained using the procedure described in ASTM D2343 and X934 epoxy resin available from the Fiberite Corporation.

The results are summarized below wherein the strength and modulus reported are based solely on the cross-sectional areas of the fibers in the cured epoxy resin.

| Composite Property | Example II | Untreated Control |
|---|---|---|
| Strand Tensile Strength | 564,000 psi | 495,000 psi |
| Strand Tensile Modulus | 38,200,000 psi | 36,600,000 psi |
| Strand Tensile Elongation | 1.48 percent | 1.35 percent |

In the above Example both the strength and the elongation are enhanced by approximately 10 to 15 percent which is in excess of the normal scatter of data associated with this measurement technique.

EXAMPLE III

Example I was substantially repeated with the exception that an intermediate strength relatively high modulus tape of carbonaceous filamentary material was selected as the starting material and the surface treatment zone 26 was maintained at a temperature of approximately 800° C. The carbonaceous filamentary material contained in excess of 95 percent carbon by weight, included a substantial quantity of graphitic carbon, was derived from an acrylonitrile homopolymer, and was commercially available from the Celanese Corporation under the designation of GY-70 graphite fiber. The tape was composed of approximately 300 substantially parallel side-by-side fiber bundles consisting of approximately 384 filaments per bundle which were joined by a cross-weave of a multifilamentary carbonaceous fibrous material. The starting material had been thermally stabilized in an oxygen-containing atmosphere and subsequently converted to the carbonaceous form by heating at a more highly elevated temperature in a non-oxidizing atmosphere which in a final step was provided at a maximum temperature in excess of 2700° C. The starting material had undergone no prior surface treatment.

Representative filament properties for the starting material were an average denier of approximately 0.95, an average tensile strength of approximately 250,000 psi, an average Young's modulus of approximately 74,000,000 psi, and an average elongation of approximately 0.34 percent. Representative filament properties following the surface treatment were an average denier of 0.95, an average tensile strength of approximately 247,000 psi, an average Young's modulus of approximately 74,000,000 psi, and an average elongation of 0.31 percent.

The results are summarized below for the composite test bars normalized to a fiber concentration of 62 percent by volume.

| Composite Property | Example III | Untreated Control |
|---|---|---|
| Flexural Strength | 128,000 psi | 102,000 psi |
| Flexural Modulus | 37,800,000 psi | 38,200,000 psi |
| Horizontal Interlaminar Shear Strength | 7,000 psi | 2,710 psi |
| Tensile Strength | 101,000 psi | 132,000 psi |
| Tensile Modulus | 42,700,000 psi | 46,100,000 psi |
| Elongation | 0.23 percent | 0.23 percent |

As in Example I, the horizontal interlaminar shear strength of the resulting test bars was substantially improved.

EXAMPLE IV

Example I was substantially repeated with the exception that an intermediate strength relatively high modulus carbon fiber derived from a pitch precursor was selected. The carbon fiber was obtained from the Union Carbide Corporation under the designation VSB32T. The particular material treated was from Lot 507-800 and according to supplier information had not been surface treated to improve composite performance. Several yarns composed of 2000 filaments each were fed through the surface treatment zone which was maintained at 500° C. Once again the time of exposure at the highest temperature was approximately 30 seconds. Following this treatment the treated fiber and an untreated control were evaluated by the measurement of composite mechanical properties wherein the resin matrix was X934 epoxy resin from the Fiberite Corporation. The composition of the treatment gas was 9 percent by volume nitrogen dioxide and 91 percent by volume air. The measured mechanical properties which were normalized to a fiber concentration of 65 percent by volume and are summarized below.

| Composite Property | Example IV | Untreated Control |
|---|---|---|
| Flexural Strength | 107,000 psi | 103,000 psi |
| Flexural Modulus | 30,400,000 psi | 30,300,000 psi |
| Horizontal Interlaminar Shear Strength | 8,310 psi | 3,880 psi |
| Tensile Strength | 101,000 psi | 143,000 psi |
| Tensile Modulus | 35,000,000 psi | 33,100,000 psi |
| Tensile Elongation | 0.29 percent | 0.44 percent |

As in the preceding examples the interlaminar shear strength is substantially improved (in excess of 200 percent in this instance). Although there was an accompanying decrease in tensile strength and elongation, the decrease was only 30 to 35 percent which was significantly less than the shear enhancement. In addition, the flexural strength is essentially unchanged by the treatment.

Although the invention has been described with preferred embodiments, it is to be understood that variations and modifications can be resorted to as will be apparent to those skilled in the art. Such variations are to be considered within the scope and purview of the claims appended hereto.

We claim:

1. An improved process for the modification of the surface characteristics of a carbonaceous fibrous material containing at least 90 percent carbon by weight so as to improve its ability to bond to a resinous matrix material while retaining a substantial portion of the tensile strength thereof comprising:

(a) continuously feeding to a substantially enclosed surface treatment zone maintained at a temperature of approximately 300° to 800° C. a gaseous atmosphere comprising approximately 1 to 25 percent by volume nitrogen dioxide and approximately 75 to 99 percent by volume air, (b) continuously passing a continuous length of said carbonaceous fibrous material in the direction of its length through said surface treatment zone for a residence time of approximately 20 to 180 seconds, and (c) continuously withdrawing the resulting continuous length of carbonaceous fibrous material from said surface treatment zone.

2. An improved process for the modification of the surface characteristics of a carbonaceous fibrous material according to claim 1 wherein said carbonaceous fibrous material which undergoes surface modification contains at least 93 percent carbon by weight.

3. An improved process for the modification of the surface characteristics of a carbonaceous fibrous material according to claim 1 wherein said carbonaceous fibrous material which undergoes surface modification contains at least 99 percent carbon by weight.

4. An improved process for the modification of the surface characteristics of a carbonaceous fibrous material according to claim 1 wherein said carbonaceous fibrous material which undergoes surface modification includes a substantial quantity of graphitic carbon.

5. An improved process for the modification of the surface characteristics of a carbonaceous fibrous material according to claim 1 wherein said carbonaceous fibrous material which undergoes surface modification is derived from an acrylic fibrous material selected from the group consisting of an acrylonitrile homopolymer and acrylonitrile copolymers which contain at least 85 mole percent acrylonitrile units and up to about 15 mole percent of one or more monovinyl units copolymerized therewith.

6. An improved process for the modification of the surface characteristics of a carbonaceous fibrous material according to claim 1 wherein the carbonaceous fibrous material is derived for a pitch fibrous material.

7. An improved process for the modification of the surface characteristics of a carbonaceous fibrous material according to claim 1 wherein said carbonaceous fibrous material which undergoes surface modification is a continuous multifilament yarn.

8. An improved process for the modification of the surface characteristics of a carbonaceous fibrous material according to claim 1 wherein said carbonaceous fibrous material which undergoes surface modification is a continuous multifilament tow.

9. An improved process for the modification of the surface characteristics of a carbonaceous fibrous material according to claim 1 wherein said gaseous atmosphere which is fed to said surface treatment zone comprises approximately 2 to 10 percent by volume nitrogen dioxide, and approximately 90 to 98 percent by volume air.

10. An improved process for the modification of the surface characteristics of a carbonaceous fibrous material according to claim 1 wherein said carbonaceous fibrous material which undergoes surface modification exhibits an average single filament tensile strength of at least 200,000 psi prior to said surface modification, and retains at least 70 percent of said average single filament tensile strength following said surface modification.

11. An improved process for the modification of the surface characteristics of a carbonaceous fibrous material containing at least 90 percent carbon by weight and exhibiting an average single filament Young's modulus of approximately 30 to 50 million psi so as to improve its ability to bond to a resinous matrix material while retaining a substantial portion of the tensile strength thereof comprising:

(a) continuously feeding to a substantially enclosed surface treatment zone maintained at a temperature of approximately 320° to 440° C. a gaseous atmosphere comprising approximately 2 to 10 percent by volume nitrogen dioxide and approximately 90 to 98 percent by volume air, (b) continuously passing a continuous length of said carbonaceous fibrous material in the direction of its length through said surface treatment zone for a residence time of approximately 25 to 90 seconds, and (c) continuously withdrawing the resulting continuous length of carbonaceous fibrous material from said surface treatment zone.

12. An improved process for the modification of the surface characteristics of a carbonaceous fibrous material according to claim 11 wherein said carbonaceous fibrous material which undergoes surface modification contains at least 95 percent carbon by weight.

13. An improved process for the modification of the surface characteristics of a carbonaceous fibrous material according to claim 11 wherein said carbonaceous fibrous material which undergoes surface modification includes a substantial quantity of graphitic carbon.

14. An improved process for the modification of the surface characteristics of a carbonaceous fibrous material according to claim 11 wherein said carbonaceous fibrous material which undergoes surface modification is derived from an acrylic fibrous material selected from the group consisting of an acrylonitrile homopolymer and acrylonitrile copolymers which contain at least 85 mole percent of one or more monovinyl units copolymerized therewith.

15. An improved process for the modification of the surface characteristics of a carbonaceous fibrous material according to claim 11 wherein said carbonaceous fibrous material is derived from a pitch fibrous material.

16. An improved process for the modification of the surface characteristics of a carbonaceous fibrous material according to claim 11 wherein said carbonaceous fibrous material which undergoes surface modification is a continuous multifilament yarn.

17. An improved process for the modification of the surface characteristics of a carbonaceous fibrous material according to claim 11 wherein said carbonaceous fibrous material which undergoes surface modification is a continuous multifilament tow.

18. An improved process for the modification of the surface characteristics of a carbonaceous fibrous material according to claim 11 wherein said gaseous atmosphere which is fed to said surface treatment zone comprises approximately 4 percent by volume nitrogen dioxide, and approximately 96 percent by volume air.

19. An improved process for the modification of the surface characteristics of a carbonaceous fibrous material according to claim 11 wherein said carbonaceous fibrous material which undergoes surface modification exhibits an average single filament tensile strength of at least 200,000 psi prior to said surface average single filament tensile strength following said surface modification.

20. An improved process for the modification of the surface characteristics of a carbonaceous fibrous material containing at least 95 percent carbon by weight and a substantial quantity of graphitic carbon and exhibiting an average single filament Young's modulus of at least 60 million psi so as to improve its ability to bond to a resinous matrix material while retaining a substantial portion of the tensile strength thereof comprising:

(a) continuously feeding to a substantially enclosed surface treatment zone maintained at a temperature of approximately 450° to 800° C. a gaseous atmosphere comprising approximately 2 to 10 percent by volume nitrogen dioxide and approximately 90 to 98 percent by volume air, (b) continuously passing a continuous length of said carbonaceous fibrous material in the direction of its length through said surface treatment zone for a residence time of approximately 25 to 90 seconds, and (c) continuously withdrawing the resulting continuous length of carbonaceous fibrous material from said surface treatment zone.

21. An improved process for the modification of the surface characteristics of a carbonaceous fibrous material according to claim 20 wherein said carbonaceous fibrous material which undergoes surface modification contains at least 99 percent carbon by weight.

22. An improved process for the modification of the surface characteristics of a carbonaceous fibrous material according to claim 20 wherein said carbonaceous fibrous material which undergoes surface modification is derived from an acrylic fibrous material selected from the group consisting of an acrylonitrile homopolymer and acrylonitrile copolymers which contain at least 85 mole percent acrylonitrile units and up to about 15 mole percent of one or more monovinyl units copolymerized therewith.

23. An improved process for the modification of the surface characteristics of a carbonaceous fibrous material according to claim 20 wherein said carbonaceous fibrous material is derived from a pitch fibrous material.

24. An improved process for the modification of the surface characteristics of a carbonaceous fibrous material according to claim 20 wherein said carbonaceous fibrous material which undergoes surface modification is a continuous multifilament yarn.

25. An improved process for the modification of the surface characteristics of a carbonaceous fibrous material according to claim 20 wherein said carbonaceous fibrous material which undergoes surface modification is a continuous multifilament tow.

26. An improved process for the modification of the surface characteristics of a carbonaceous fibrous material according to claim 20 wherein said gaseous atmosphere which is fed to said surface treatment zone comprises approximately 4 percent by volume nitrogen dioxide and approximately 96 percent by volume air.

27. An improved process for the modification of the surface characteristics of a carbonaceous fibrous material according to claim 20 wherein said carbonaceous fibrous material which undergoes surface modification exhibits an average single filament tensile strength of at least 200,000 psi prior to said surface modification, and retains at least 70 percent of said average single filament tensile strength following said surface modification.

* * * * *